US011739467B2

(12) United States Patent
Amador Zamarreno et al.

(10) Patent No.: US 11,739,467 B2
(45) Date of Patent: Aug. 29, 2023

(54) METHOD OF TREATING FABRICS WITH SELECTIVE DOSING OF AGITATION-SENSITIVE INGREDIENTS

(71) Applicant: The Procter & Gamble Company, Cincinnati, OH (US)

(72) Inventors: Carlos Amador Zamarreno, Newcastle Upon Tyne (GB); Anju Deepali Massey Brooker, Newcastle Upon Tyne (GB); Laura Bueno Romo, Newcastle Upon Tyne (GB); Libbi Moon, Newcastle (GB); Despeina Zympeloudi, Newcastle (GB); Philip Frank Souter, Newcastle (GB)

(73) Assignee: The Procter & Gamble Company, Cincinnati, OH (US)

( * ) Notice: Subject to any disclaimer, the term of this patent is extended or adjusted under 35 U.S.C. 154(b) by 509 days.

(21) Appl. No.: 16/867,611

(22) Filed: May 6, 2020

(65) Prior Publication Data

US 2020/0354877 A1 Nov. 12, 2020

(30) Foreign Application Priority Data

May 7, 2019 (EP) ..... 19172874

(51) Int. Cl.

| | |
|---|---|
| ***D06F 39/02*** | (2006.01) |
| ***D06F 33/36*** | (2020.01) |
| ***D06F 33/37*** | (2020.01) |
| *D06F 19/00* | (2006.01) |

(52) U.S. Cl.

CPC ..... *D06F 39/02* (2013.01); *D06F 33/36* (2020.02); *D06F 33/37* (2020.02); *D06F 19/00* (2013.01)

(58) Field of Classification Search

CPC ..... D06F 33/36; D06F 33/37; D06F 35/006; D06F 39/02

See application file for complete search history.

(56) References Cited

U.S. PATENT DOCUMENTS

| | | | |
|---|---|---|---|
| 9,493,900 | B2 | 11/2016 | Ban |
| 2003/0116177 | A1 | 6/2003 | Appel |
| 2013/0031872 | A1 | 2/2013 | Blaiss |
| 2013/0036775 | A1 | 2/2013 | Brueckner |

(Continued)

FOREIGN PATENT DOCUMENTS

| | | | |
|---|---|---|---|
| CA | 105568632 | 5/2016 | |
| CN | 1197137 A * | 10/1998 | ..... D06F 35/006 |

(Continued)

OTHER PUBLICATIONS

Machine translation of DE-10151696-A1, dated Apr. 2003. (Year: 2003).*

(Continued)

*Primary Examiner* — Michael E Barr
*Assistant Examiner* — Kevin G Lee

(57) ABSTRACT

The present invention provides a method for treating fabrics by employing an automatic laundry washing machine to selectively add agitation-sensitive detersive actives into the wash liquor during a wash cycle when the mechanical agitation power applied to the fabrics by said washing machine is more than 12 W/kg, so as to improve or optimize the cleaning performance of such agitation-sensitive detersive actives.

14 Claims, 2 Drawing Sheets

(56) References Cited

U.S. PATENT DOCUMENTS

| | | | | |
|---|---|---|---|---|
| 2013/0175293 | A1* | 7/2013 | Burgess | D06F 39/022 222/129 |
| 2013/0185872 | A1* | 7/2013 | Chanda | D06F 34/18 68/12.04 |
| 2013/0318724 | A1 | 12/2013 | Wong | |
| 2014/0023015 | A1 | 1/2014 | Frederiksen | |
| 2017/0233924 | A1 | 8/2017 | Ihne et al. | |

FOREIGN PATENT DOCUMENTS

| | | | |
|---|---|---|---|
| DE | 1015696 | | 9/1957 |
| DE | 10151696 | A1 | 4/2003 |
| EP | 2086094 | A2 | 8/2009 |
| EP | 2086094 | | 12/2010 |
| EP | 2767581 | A1 | 8/2014 |
| JP | 2014501550 | A | 1/2014 |
| WO | WO2016/008324 | A1 | 1/2016 |
| WO | WO2019063402 | A1 | 4/2019 |

OTHER PUBLICATIONS

Extended European Search Report and Search Opinion; Application Ser. No. 19172874.0; dated Nov. 11, 2019; 8 pages.

PCT Search Report for appl. No. PCT/US2020/030897, dated Jul. 14, 2020, 7 pages.

* cited by examiner

AB - Initial Noticeability
CD - Washed Noticeability
AC - Redeposition figure or Whiteness drop
BD - Stain Change

METHOD OF TREATING FABRICS WITH SELECTIVE DOSING OF AGITATION-SENSITIVE INGREDIENTS

FIELD OF THE INVENTION

This method relates to a method of treating fabrics using an automatic laundry washing machine for selecting dosing of agitation-sensitive ingredients.

BACKGROUND OF THE INVENTION

On one hand, mechanical agitation applied to fabrics by automatic washing machine during wash is known to improve cleaning performance. It may count for a majority of the total cleaning performance achieved by an automatic wash cycle. However, there is limited space for increasing the mechanical agitation power during wash, for several reasons. For example, the mechanical and electric configurations of the automatic washing machine may limit how much mechanical agitation power can be applied to the fabrics. Further, excessive mechanical agitation power applied to the fabrics may lead to either immediate damage to the fabric or chronical deterioration thereof. Still further, an increase in the mechanical agitation power applied by the automatic washing machine also requires more energy input/consumption, which in turn leads to higher cost and greater impact on the environment.

On the other hand, the laundry detergent composition added into the automatic washing machine for treating the fabrics during wash is known to further improve the cleaning performance. Although it is possible to add more types/amounts of detersive actives in wash to improve the cleaning performance, such additives will inevitably increase the manufacturing costs and processing complexity associated with the laundry detergent composition. Further, more detersive additives in wash may have a negative impact on the structural integrity of fabrics being treated and may also lead to a greater environmental footprint.

Therefore, there is a need to provide a method of treating fabrics to achieve improved cleaning performance, but without the need for either increasing the mechanical agitation power applied by the automatic washing machine or adding more types/amounts of detersive actives into the wash cycle.

SUMMARY OF THE INVENTION

It has been discovered by the present invention that certain detersive actives may render a synergistically improved cleaning performance when used in combination with higher mechanical agitation power (i.e., above a specific threshold). Such detersive actives are hereinafter referred to as "agitation-sensitive ingredients." Correspondingly, the present invention provides a method and mechanism to capitalize such synergy by configuring an automatic laundry washing machine to selectively dose the agitation-sensitive ingredients based on the mechanical agitation power available.

In one aspect, the present invention provides a method of treating fabrics using an automatic laundry washing machine, comprising the steps of:

a) providing an automatic laundry washing machine configured for adding a plurality of detersive actives during a wash cycle, wherein said plurality of detersive actives comprise at least one agitation-sensitive ingredient;
b) determining mechanical agitation power in the automatic laundry washing machine during wash;

c) adding said at least one agitation-sensitive ingredient into a wash liquor, provided that the determined mechanical agitation power is more than 12 W/kg, preferably more than 17 W/kg, more preferably more than 25 W/kg; and
d) operating said automatic laundry washing machine to treat fabrics by using said wash liquor.

Preferably, said at least one agitation-sensitive ingredient comprises a lipase. More preferably, the lipase is added into the wash liquor during step (c) to achieve a Through-the-Wash (TTW) dosage of from 0.05 ppm to 2 ppm, preferably from 0.1 ppm to 1 ppm, more preferably from 0.2 ppm to 0.5 ppm.

Alternative to or in combination with the lipase, said at least one agitation-sensitive ingredient may comprise a $C_{10}$-$C_{20}$ linear alkyl benzene sulphonate (LAS). Preferably, said LAS is added into the wash liquor during step (c) to achieve a TTW dosage of from 100 ppm to 1500 ppm, preferably from 200 ppm to 1000 ppm, more preferably from 250 ppm to 500 ppm.

Alternative to or in combination with the lipase and/or LAS, the at least one agitation-sensitive ingredient may comprise a polyester-based soil release polymer (SRP). Preferably, said SRP is added into the wash liquor during step (c) to achieve a TTW dosage of from 5 ppm to 150 ppm, preferably from 10 ppm to 100 ppm, more preferably from 20 ppm to 80 ppm.

Before the addition of said at least one agitation-sensitive ingredient in step (c), the wash liquor may be substantially free of the agitation-sensitive ingredient; alternatively, the wash liquor may comprise the agitation-sensitive ingredient, but at a TWW dosage lower than those described hereinabove.

In a preferred but not necessary embodiment of the present invention, the said automatic laundry washing machine comprises two cartridges, one of which is configured to house a high-agitation liquid laundry detergent composition, and the other of which is configured to house a low-agitation liquid laundry detergent composition. The differences between said high-agitation and low-agitation liquid laundry detergent compositions may be qualitative or quantitative. In the former scenario, the high-agitation liquid laundry detergent composition comprises the at least one agitation-sensitive ingredient, while the low-agitation liquid laundry detergent composition is substantially free of such at least one agitation-sensitive ingredient. In the latter scenario, the high-agitation liquid laundry detergent composition comprises the at least one agitation-sensitive ingredient at a first concentration, while the low-agitation liquid laundry detergent composition comprises the at least one agitation-sensitive ingredient at a second, lower concentration. More preferably, the low-agitation liquid detergent composition is a pre-treatment formulation that is added into the wash liquor before step (c), while said high-agitation liquid detergent composition is added subsequently into the wash liquor during step (c). Alternatively, the low-agitation liquid detergent composition is added into the wash liquor during step (c) if the determined mechanical agitation power is equal to or below 12 W/kg.

Method of the present invention may comprise one or more additional steps after step (d) described hereinabove. For example, the method may further comprise the following steps:

e) conducting another measurement of the mechanical agitation power in the automatic laundry washing machine; and f) subsequently, adding a suds suppressor into said wash liquor if the measured mechanical agitation power decreases below 12 W/kg.

Preferably, the suds suppressor is added into the wash liquor during step (f) to achieve a TTW dosage of from 50 ppm to 1000 ppm, preferably from 100 ppm to 500 ppm, more preferably from 150 ppm to 300 ppm.

In another aspect, the present invention is related to an automatic washing machine comprising a cleaning chamber, a water supply, and two detergent cartridges; wherein one of said two detergent cartridges is configured to house a high-agitation liquid laundry detergent composition comprising at least one agitation-sensitive ingredient at a first concentration; wherein the other of said two detergent cartridges is configured to house a low-agitation liquid laundry detergent composition that is either substantially free of said at least one agitation-sensitive ingredient, or comprises said at least one agitation-sensitive ingredient at a second, lower concentration; and wherein said automatic washing machine is configured to determine mechanical agitation power therein during wash and to add said high-agitation liquid laundry detergent composition to a wash liquor for treating fabrics if the determined mechanical agitation power is more than 12 W/kg.

This and other aspects of the present invention will become more apparent upon reading the following detailed description of the invention.

DETAILED DESCRIPTION OF THE INVENTION

Figure 1:
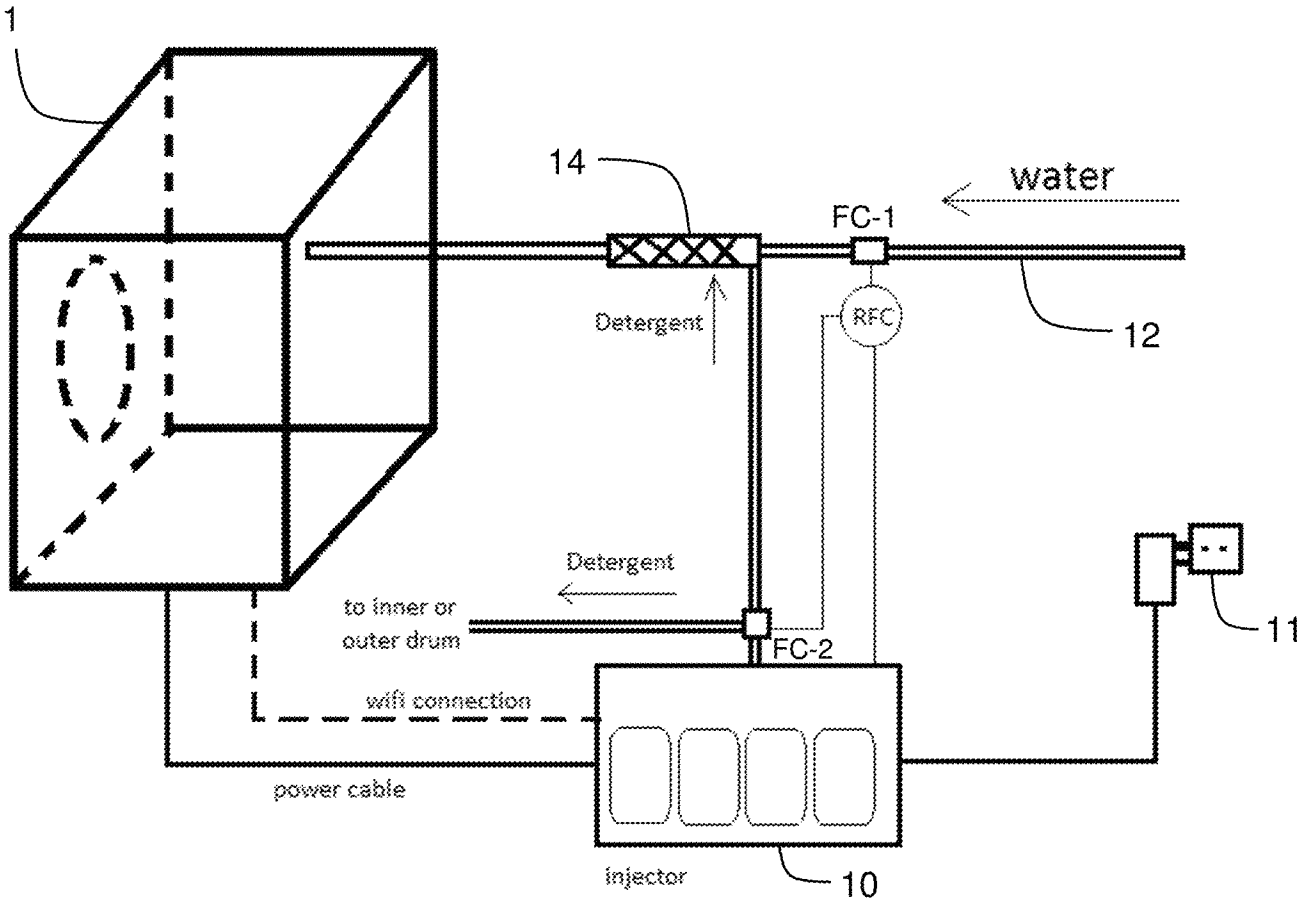
FIG. 1 is a schematic diagram of an automatic washing machine configured for selectively dosing agitation-sensitive ingredients based on the mechanical agitation power determined, according to one embodiment of the present invention.
Figure 2:
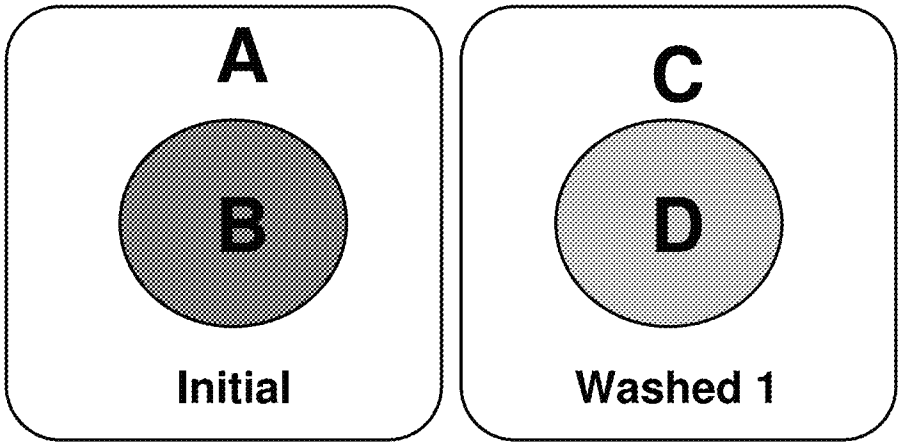
FIG. 2 is a schematic diagram of a stain before and after wash.

As used herein, the term "agitation-sensitive ingredient" or "agitation-sensitive ingredients" refers to detersive ingredients that exhibit synergistically improved cleaning performance when combined with a higher agitation power. The term "cleaning performance" is interpreted broadly to cover stain removal benefit and/or whiteness maintenance benefit. The term "stain" as used herein broadly encompass any type of fabric stains, including but not limited to grease stains, food stains, grass stains, makeup stains, etc.

As used herein, the term "mechanical agitation power" as used herein refers to the average power used by the automatic washing machine when the cleaning drum of such washing machine is rotating to rotate or agitate fabrics insider the cleaning chamber of such washing machine, which is measured as watts per kilograms of fabrics (W/kg) according to the test method described hereinafter (Test 1). It is important to note that the final mechanical agitation power applied onto the fabrics depends not only on the mechanics/geometry of washing machine, but also on various other factors, e.g., the type and weight of fabrics added, sudsing behavior of the detergent product used, etc.

As used herein, the term "substantially free of" means that the indicated material is not deliberately added to the composition to form part of it. It is meant to include compositions whereby the indicated material is present only as an impurity in one of the other materials deliberately included. Preferably, the indicated material is not present at analytically detectable levels.

As used herein, articles such as "a" and "an" when used in a claim, are understood to mean one or more of what is claimed or described. The terms "comprise," "comprises," "comprising," "contain," "contains," "containing," "include," "includes" and "including" are all meant to be non-limiting.

As used herein, all concentrations and ratios are on a weight basis unless otherwise specified. All temperatures herein are in degrees Celsius (° C.) unless otherwise indicated. All conditions herein are at 20° C. and under the atmospheric pressure, unless otherwise specifically stated.

Agitation-Sensitive Ingredient

The agitation-sensitive ingredient of the present invention can be any detersive ingredient that exhibit synergistically improved cleaning performance when used in combination with a higher mechanical agitation power (e.g., more than 12 W/kg). Preferably, such agitation-sensitive ingredient is selected from the group consisting of lipase, $C_{10}$-$C_{20}$ linear alkyl benzene sulphonate (LAS), polyester-based soil release polymer (SRP), and mixtures thereof.

Lipase

It has been a surprising and unexpected discovery of the present invention that unlike other enzymes (such as protease and amylase), lipase exhibits a synergistically improved grease removal benefit when it is used in combination with a higher mechanical agitation power, e.g., more than 12 W/kg, preferably more than 17 W/kg, more preferably more than 25 W/kg.

The lipase used in the present invention may be a lipolytic enzyme in class EC 3.1.1 as defined by Enzyme Nomenclature. It is preferably a first-wash lipid esterase selected from the following:

(1) Triacylglycerol lipases (E.C. 3.1.1.1) exhibiting first wash activity (2) Cutinase (E.C. 3.1.1.74)

(3) Sterol esterase (E.C. 3.1.1.13)

(4) Wax-ester hydrolase (E.C. 3.1.1.50)

The lipolytic enzyme may in particular be a triacylglycerol lipase exhibiting first wash activity, which can be selected from variants of the *Humicola lanuginosa* (*Thermomyces lanuginosus*) lipase, such as Lipex™, Lipolex™ and Lipoclean™ (all products of Novozymes in Bagsvaerd, Denmark). Most preferably, the first wash triacylglycerol lipase is selected from *Humicola lanuginosa* lipase variants with mutations T231R and N233R. Other suitable first wash triacylglycerol lipases can be selected from variants of *Pseudomonas* lipases, e.g., from *P. alcaligenes* or *P. pseudoalcaligenes, P. cepacia, P. stutzeri, P. fluorescens, Pseudomonas* sp. strain SD 705, *P. wisconsinensis, Bacillus* lipases, e.g., from *B. subtilis, B. stearothermophilus* or *B. pumilus.*

Suitable cutinases may be derived from a strain of *Aspergillus*, in particular *Aspergillus oryzae*, a strain of *Alternaria*, in particular *Alternaria brassiciola*, a strain of *Fusarium*, in particular *Fusarium solani, Fusarium solani pisi, Fusarium oxysporum, Fusarium oxysporum cepa, Fusarium roseum culmorum*, or *Fusarium roseum* sambucium, a strain of Helminthosporum, in particular Helminthosporum *sativum*, a strain of *Humicola*, in particular *Humicola insolens*, a strain of *Pseudomonas*, in particular *Pseudomonas mendocina*, or *Pseudomonas putida*, a strain of *Rhizoctonia*, in particular *Rhizoctonia solani*, a strain of *Streptomyces*, in particular *Streptomyces* scabies, a strain of *Coprinopsis*, in particular *Coprinopsis cinerea*, a strain of Thermobifida, in particular Thermobifida *fusca*, a strain of *Magnaporthe*, in particular *Magnaporthe grisea*, or a strain of *Ulocladium*, in particular *Ulocladium consortiale*.

In a preferred embodiment, the cutinase is selected from variants of the *Pseudomonas mendocina* cutinase, such as the variant with three substitutions at I178M, F180V, and S205G. In another preferred embodiment, the cutinase is a wild-type or variant of the six cutinases endogenous to *Coprinopsis cinerea*. In another preferred embodiment, the cutinase is a wild-type or variant of the two cutinases endogenous to *Trichoderma reesei*. In a most preferred embodiment the cutinase is derived from a strain of *Humicola insolens*, in particular the strain *Humicola insolens* DSM 1800. Preferred commercial cutinases include Novozym 51032 (available from Novozymes, Bagsvaerd, Denmark).

Suitable sterol esterases may be derived from a strain of *Ophiostoma*, for example *Ophiostoma piceae*, a strain of *Pseudomonas*, for example *Pseudomonas aeruginosa*, or a strain of *Melanocarpus*, for example *Melanocarpus albomyces*. In a most preferred embodiment the sterol esterase is the *Melanocarpus albomyces* sterol esterase described in H. Kontkanen et al, Enzyme Microb Technol., 39, (2006), 265-273.

Suitable wax-ester hydrolases may be derived from *Simmondsia chinensis*.

Because lipase is protease-sensitive, it is desirable to place protease (if used for the wash) in a separate container or compartment from that used to house the lipase.

Further, lipase residue on fabrics may cause malodour release over time. Acidic rinse is effective for removing lipase from the fabric surface and mitigate the malodour issue. Therefore, in certain embodiments where lipase is used during the main wash, it is desirable to have the main wash be followed by an acidic rinse, which may have a pH value of about 4. Without wishing to be bound by any theory, it is believed such an acidic rinse can reduce the lipase deposition onto the fabric and therefore allow high lipase dosage levels to be used during the main wash (even for lipases that are not long-chain specific).

Still further, ester-based pro-perfumes (such as hexarose) can be activated by lipase in the rinse/post-wash to give rise to a pleasant perfume bloom (containing perfumes such as geraniol). Therefore, in one preferred embodiment, the rinse composition used after the main wash comprises one or more ester pro-perfumes. Such ester pro-perfumes act as a substrate for residual lipase and can be released to provide benefits on wet and/or dry fabric odour.

LAS

It has also been a surprising and unexpected discovery that the anionic surfactant $C_{10}$-$C_{20}$ linear alkyl benzene sulphonate (LAS) exhibits a synergistically improved stain removal benefit when it is used in combination with a higher mechanical agitation power, e.g., more than 12 W/kg, preferably more than 17 W/kg, more preferably more than 25 W/kg. In comparison, $C_{10}$-$C_{20}$ linear or branched alkylalkoxylated sulfate (AAS), which is also an anionic surfactant, does not exhibit such synergy with high agitation.

LAS as used herein may be selected from alkali metal salts of alkyl benzene sulfonates, in which the alkyl group contains from about 10 to about 20 carbon atoms in straight chain (linear) configuration. Preferably, the LAS may have an average number of carbon atoms in the alkyl group of from about 11 to about 16, more preferably from about 12 to about 14. Sodium salts of LAS are typically used. In one aspect, a potassium or magnesium salt of LAS is used.

Suitable LAS may be obtained, by sulphonating commercially available linear alkyl benzene (LAB) followed by neutralization. Suitable alkylbenzene feedstocks can be made from olefins, paraffins or mixtures thereof using any suitable alkylation scheme, including sulfuric and HF-based processes. By varying the precise alkylation catalyst, it is possible to widely vary the position of covalent attachment of benzene to an aliphatic hydrocarbon chain. A particular preferred LAS is obtained by DETAL catalyzed process, although other synthesis routes, such as HF, may also be suitable. Preferred LAB includes low 2-phenyl LAB, such as those supplied by Sasol under the tradename Isochem® or those supplied by Petresa under the tradename Petrelab®. Another suitable LAB includes high 2-phenyl LAB, such as those supplied by Sasol under the tradename Hyblene®. Accordingly, the resulting LAS can vary widely in 2-phenyl isomer and/or internal isomer content.

Soil Release Polymer (SRP)

Although the laundering process can effectively remove stains from fabrics, it may cause an overall loss of fabric whiteness over time due to soil redeposition onto the fabrics. Soil release polymers (SRP) are known to prevent soil redeposition and reduce whiteness loss. Mechanical agitation, however, may lead to more soil redeposition onto the fabrics over time due to soil particulates penetrating deeper into the fabrics structure, which in turn leads to greater whiteness loss. Therefore, it has been a surprising and unexpected discovery of the present invention that SRP is more effective in preventing soil redeposition and reducing whiteness loss under higher mechanical agitation power. In other words, SRP exhibits a synergistically improved whiteness maintenance benefit when it is used in combination with higher mechanical agitation power, e.g., more than 12 W/kg, preferably more than 17 W/kg, more preferably more than 25 W/kg.

Suitable SRPs for practice of the present invention may have a structure as defined by one of the following structures (I), (II) or (III):

$$—[(OCHR^1—CHR^2)_aO—OC—Ar—CO-]_d \quad (I)$$

$$—[(OCHR^3—CHR^4)_b—O—OC\text{-}sAr\text{-}CO-]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Preferably, the SPR is a polyester-based polymer, such as Repel-O-Tex® polymers, including Repel-O-Tex® SF, SF-2 and SRP6 supplied by Rhodia. Other suitable soil release polymers include Texcare® polymers, including Texcare® SRA100, SRA300, SRN100, SRN170, SRN240, SRN300 and SRN325 supplied by Clariant. Other suitable soil release polymers are Marloquest® polymers, such as Marloquest® SL supplied by Sasol.

More preferably, the SRP is a block polyester with repeating units of alkylene terephthalate units, e.g., comprising about 10-30% by weight of alkylene terephthalate units together with about 90-70% by weight of polyoxyethylene terephthalate units, derived from a polyoxyethylene glycol having an average molecular weight of 300-8000. This polymer is the commercially available substances for example Texcare© SRN170 and Texcare©SRN260 from Clariant.

Method of Treating Fabrics by Selective Dosing of Agitation-Sensitive Ingredients The present invention seeks to achieve optimal cleaning performance while minimizing cost and environmental footprint of laundering, by selectively dosing one or more of the above-described agitation-sensitive ingredients when and only when the mechanical agitation power applied by the automatic washing machine to the fabrics is above a minimal threshold, e.g., more than 12 W/kg, preferably more than 17 W/kg, more preferably more than 25 W/kg. Until then, the agitation-sensitive ingredients are either not added to the wash liquor at all, or only are added at minimal amounts that are significantly below their optimal Through-the-Wash (TTW) dosages. In this manner, the agitation-sensitive ingredients are "reserved" for high agitation washing conditions, so as to capitalize the synergistic cleaning performance achieved by the combination of such agitation-sensitive ingredients and high mechanical agitation power and to minimize cost and environmental footprint of laundering.

In order to achieve such selective dosing of the agitation-sensitive ingredients during the wash cycle, it is necessary to provide first an automatic laundry washing machine capable of selectively adding a plurality of detersive actives into a wash liquor during the wash cycle, while such plurality of detersive active include at least one agitation-sensitive ingredient as described hereinabove. Next, the mechanical agitation power applied by the automatic laundry washing machine to the fabrics during wash is determined, according to the method described hereinafter (Test 1). If the determined mechanical agitation power is above a minimal threshold, e.g., more than 12 W/kg, preferably more than 17 W/kg, more preferably more than 25 W/kg, said at least one agitation-sensitive ingredient is then added into the wash liquor, which is in turn used by the automatic laundry washing machine to treat the fabrics.

In the above-described process, if lipase is added as the agitation-sensitive ingredient into the wash liquor when the minimal threshold of mechanical agitation power is reached, it is preferred that such lipase is added into the wash liquor at an amount sufficient to achieve a Through-the-Wash (TTW) dosage of from 0.05 ppm to 2 ppm, preferably from 0.1 ppm to 1 ppm, more preferably from 0.2 ppm to 0.5 ppm. Alternatively or additionally to lipase, if LAS is added as the agitation-sensitive ingredient into the wash liquor when the minimal threshold of mechanical agitation power is reached, it is preferred that it is added into the wash liquor at an amount sufficient to achieve a TTW dosage of from 100 ppm to 1500 ppm, preferably from 200 ppm to 1000 ppm, more preferably from 250 ppm to 500 ppm. Alternatively or additionally to lipase and/or LAS, if SRP is added as the agitation-sensitive ingredient into the wash liquor when the minimal threshold of mechanical agitation power is reached, it is preferred that it is added into the wash liquor at an amount sufficient to achieve a TTW dosage of from 5 ppm to 150 ppm, preferably from 10 ppm to 100 ppm, more preferably from 20 ppm to 80 ppm.

The above-described selective dosing process can be implemented in various embodiments, which are described hereinafter.

In a specific embodiment, the automatic washing machine may be configured to operate at two or more different agitation modes based on consumer's input through a control panel. If the low agitation mode is selected by the consumers for a specific wash cycle (e.g., with the predetermined mechanical agitation power at or below 12 W/kg), then the automatic washing machine doses all other detersive actives into the wash liquor while holding off the agitation-sensitive ingredients, or only dosing them at relatively small amounts, i.e., below the amounts required for achieving the above-described TTW dosages desired for optimal cleaning performance under the high agitation power, or dosing them in lower ratios in relation to the rest of surfactants and enzymes. If the high agitation mode is selected by the consumers for another wash cycle (e.g., with the pre-determined mechanical agitation power at more than 12 W/kg, preferably more than 17 W/kg, more preferably more than 25 W/kg), then the automatic washing machine doses the agitation-sensitive ingredients into the wash liquor, either at the same time with all other detersive actives or separately at different times.

In another embodiment, the automatic washing machine may be configured to operate at a dynamic agitation mode that starts with a low mechanical agitation power (e.g., at or below 12 W/kg) at the beginning of the wash cycle and then increases to a high mechanical agitation power (e.g., more than 12 W/kg) at a later time during the wash cycle. In this scenario, the automatic washing machine can dose all the other detersive actives without the agitation-sensitive ingredients, or only with relatively small amounts of the agitation-sensitive ingredients before the mechanical agitation power reaches above 12 W/kg, and it can then dose additional amounts of the agitation-sensitive ingredients during the wash cycle when or after the mechanical agitation power reaches above 12 W/kg.

The automatic washing machine used for achieving such selective dosing of the agitation-sensitive ingredients may have two or more detergent dispensing cartridges, at least one of which is configured to house a high-agitation liquid laundry detergent composition, and the other of which is configured to house a low-agitation liquid laundry detergent composition. Preferably, the low/high-agitation liquid laundry detergent compositions are characterized by similar or comparative surfactant activities, and they are dosed in similar amounts into the wash liquor to achieve similar TTW concentrations thereof. For example, the low/high-agitation liquid laundry detergent compositions may both be characterized by a total surfactant content ranging from about 10% to about 70%, preferably from about 12% to about 50%, more preferably from about 15% to about 40%, by total weight of the respective composition. Further, the low/high-agitation liquid laundry detergent compositions can both be dosed in such amounts so as to achieve a TTW detergent concentration ranging from about 100 ppm to about 20,000 ppm, preferably from about 500 ppm to about 5000 ppm, more preferably from about 1000 ppm to about 4000 ppm.

In one specific embodiment of the present invention, the high-agitation liquid laundry detergent composition comprises one or more agitation-sensitive ingredients, while the low-agitation liquid laundry detergent composition is substantially free of the agitation-sensitive ingredient(s). In another specific embodiment of the present invention, the high-agitation liquid laundry detergent composition comprises one or more agitation-sensitive ingredients at a first concentration (e.g., sufficient to achieve the above-described TTW dosage when added into the wash liquor), while the low-agitation liquid laundry detergent composition also comprises said agitation-sensitive ingredient(s), but at a second, lower concentration (e.g., insufficient to achieve the above-described TTW dosage when added into the wash liquor).

Preferably but not necessarily, the low-agitation liquid laundry detergent composition comprises less than 0.003%, preferably less than 0.002%, more preferably less than 0.001% of lipase by total weight of said low-agitation liquid laundry detergent composition, while the high-agitation liquid laundry detergent composition comprises at least 0.003%, preferably at least 0.005%, more preferably at least 0.01% of lipase by total weight of said high-agitation liquid laundry detergent composition.

In a more preferred embodiment of the present invention, the low-agitation laundry detergent composition contains protease but is substantially free of lipase, while the high-agitation laundry detergent composition contains lipase but is substantially free of protease. Because lipase is protease-sensitive, it is preferred to place protease in a separate cartridge from lipase.

Alternatively or additionally, the low-agitation liquid laundry detergent composition comprises less than 25%, preferably less than 20%, more preferably less than 10% of LAS by total weight of said low-agitation liquid laundry detergent composition, while the high-agitation liquid laundry detergent composition comprises at least 20%, preferably at least 25%, more preferably at least 30% of LAS by total weight of said high-agitation liquid laundry detergent composition.

Alternatively or additionally, the low-agitation liquid laundry detergent composition comprises less than 2%, preferably less than 1%, more preferably less than 0.8% of SRP by total weight of said low-agitation liquid laundry detergent composition, while the high-agitation liquid laundry detergent composition comprises at least 1%, preferably at least 1.2%, more preferably at least 3% of SRP by total weight of said high-agitation liquid laundry detergent composition.

The high-agitation liquid laundry detergent composition as mentioned hereinabove is selectively dosed if and only if the determined mechanical agitation power arises above the minimal threshold of 12 W/kg. In some scenarios, the low-agitation liquid laundry detergent composition may be the only one added into the wash liquor during wash if the mechanical agitation power applied by the automatic washing machine to the fabrics stays at or below 12 W/kg throughout the entire wash. There can also be a second or even third injection of the low-agitation composition if the mechanical agitation power continued to stay below the 12 W/kg threshold. More preferably, the low-agitation liquid detergent composition is a pre-treatment formulation that is added into the wash liquor for pre-treatment of the fabrics before the minimal threshold of mechanical agitation power is reached, while the high-agitation liquid detergent composition is added subsequently into the wash liquor when or after the minimal threshold of mechanical agitation power is reached.

In an alternative embodiment, the automatic washing machine of the present invention may have a single detergent dispensing cartridge, which is configured for housing a single liquid detergent composition that contains the agitation-sensitive ingredients together with all other detersive actives. In such a single-cartridge setup, the automatic washing machine may dose the single liquid detergent composition for a first time to achieve a first, lower TTW dosage at the beginning of the wash cycle when the mechanical agitation power is at or below 12 W/kg, and it can then dose the single liquid detergent composition for one or more additional times during the wash cycle if and only if the mechanical agitation power increases to above 12 W/kg.

Selective Dosing of Suds Suppressor

It has been discovered by the present invention that when the liquid detergent composition(s) used for treating the fabrics results in significant sudsing inside the automatic washing machine during the wash cycle, mechanical agitation power inside the cleaning drum may drop significantly over time due to excessive sudsing causing floating of the fabrics versus the preferred drag and drop motion. For example, the mechanical agitation power may drop from above 12 W/kg to below 12 W/kg, thereby changing an intended high-agitation wash to an actual low-agitation wash. In this event, it may be necessary to dose one or more suds suppressors into the wash liquor to reduce sudsing and bring the mechanical agitation power back to the desired level, e.g., above 12 W/kg.

Correspondingly, the method of the present invention may comprise the steps of conducting another measurement of the mechanical agitation power in the automatic laundry washing machine, and subsequently adding one or more suds suppressors into the wash liquor if the measured mechanical agitation power decreases below 12 W/kg.

Suitable suds suppressors (also referred to as "antifoams") for practicing of the present invention may be selected from the group consisting of monocarboxylic fatty acids and soluble salts therein, high molecular weight hydrocarbons such as paraffin, fatty acid esters (e.g., fatty acid triglycerides), fatty acid esters of monovalent alcohols, aliphatic $C_{18}$-$C_{40}$ ketones (e.g., stearone), N-alkylated amino triazines, waxy hydrocarbons preferably having a melting point below about 100° C., silicone suds suppressors, and secondary alcohols.

Silicone suds suppressors are the most commonly used and are therefore preferred for practice of the present invention. In certain examples, the suds suppressor is selected from organomodified silicone polymers with aryl or alkylaryl substituents combined with silicone resin and a primary filler, which is modified silica. In further examples, the suds suppressor is selected from: a) mixtures of from about 80 to about 92% ethylmethyl, methyl(2-phenylpropyl) siloxane; from about 5 to about 14% MQ resin in octyl stearate; and from about 3 to about 7% modified silica; b) mixtures of from about 78 to about 92% ethylmethyl, methyl(2-phenylpropyl) siloxane; from about 3 to about 10% MQ resin in octyl stearate; from about 4 to about 12% modified silica; or c) mixtures thereof, where the percentages are by weight of the suds suppressor itself. Additional suitable suds suppressors are those derived from phenylpropylmethyl substituted polysiloxanes.

The above-described suds suppressor can be added into the wash liquor whenever the measured mechanical agitation power drops to 12 W/kg or below, and the amount of suds suppressor to be added is adjusted so as to achieve a TTW dosage of from 50 ppm to 1000 ppm, preferably from 100 ppm to 500 ppm, more preferably from 150 ppm to 300 ppm. In certain scenarios, the wash liquor is substantially free of any suds suppressor before such addition. However, in most scenarios, the wash liquor already contains some suds suppressor, which is dosed together with anionic surfactants to control suds during the wash, and the subsequent addition of suds suppressor functions to provide additional sudsing control based on the mechanical agitation power measured during wash.

Other Detersive Ingredients

Besides the agitation-sensitive ingredients and suds suppressors described hereinabove, the automatic washing machine is also configured to dose various other detersive actives for treatment of the fabrics. Such other detersive actives can be dosed either separately or together with the agitation-sensitive ingredients and suds suppressors, as long as the above-described selective dosing conditions for the agitation-sensitive ingredients and suds suppressors are met.

Suitable other detersive actives can be readily selected from the group consisting of anionic surfactants (other than LAS), nonionic surfactants, cationic surfactants, zwitterionic surfactants, amphoteric surfactants, ampholytic surfactants, builders, structurants or thickeners, clay soil removal/anti-redeposition agents, polymeric dispersing agents, polymeric grease cleaning agents, enzymes (other than lipase), enzyme stabilizing systems, bleaching compounds, bleaching agents, bleach activators, bleach catalysts, brighteners, dyes, hueing agents, dye transfer inhibiting agents, chelating agents, softeners, perfumes, and mixtures thereof.

For example, the other detersive actives dosed by the automatic washing machine of the present invention may include an anionic surfactant other than LAS, e.g., a $C_{10}$-$C_{20}$ linear or branched alkylalkoxylated sulfate (AAS) having an average degree of alkoxylation ranging from 0.1 to 10, preferably from 0.3 to 8, more preferably from 0.5 to 5. Preferably, such other anionic surfactant is a $C_{10}$-$C_{20}$ linear or branched alkylethoxylated sulfate (AES) having an average degree of ethoxylation within the range described hereinabove. Preferably, said AAS or preferably AES is dosed into the wash liquor at an amount so as to reach a TTW dosage of from 50 ppm to 1000 ppm, preferably from 100 ppm to 600 ppm, more preferably from 150 ppm to 500 ppm. The other detersive actives may also include a $C_{10}$-$C_{20}$ unalkoxylated alkyl sulfate (AS), which can be dosed into the wash liquor at an amount so as to reach a TTW of from 0 ppm to about 2000 ppm, preferably from 0 ppm to about 1500 ppm, more preferably from 0 ppm to about 1000 ppm.

The other detersive actives may also include a nonionic surfactant, e.g., a $C_{10}$-$C_{20}$ alkylalkoxylated alcohol (AA) having an average degree of alkoxylation ranging from 1 to 20, preferably from 2 to 15, more preferably from 5 to 10. Preferably, said AA is dosed into the wash liquor at an amount so as to reach a TTW dosage of from 50 ppm to 1000 ppm, preferably from 100 ppm to 500 ppm, more preferably from 120 ppm to 300 ppm.

The other detersive actives may also include an amphoteric surfactant, e.g., a $C_{10}$-$C_{20}$ alkyl dimethyl amine oxide (AO). Preferably, said AO is dosed into the wash liquor at an amount so as to reach a TTW dosage of from 5 ppm to 200 ppm, preferably from 10 ppm to 100 ppm, more preferably from 15 ppm to 50 ppm.

Automatic Washing Machines and Configurations Thereof

The selective dosing of agitation-sensitive ingredients as well as the suds suppressors can be readily achieved by using an automatic washing machine that has a cleaning chamber, a water supply, and two or more detergent dispensing cartridges for housing two or more compositions (or a single detergent dispensing cartridge for housing a single composition), as mentioned hereinabove.

As shown in FIG. 1, a multi-cartridge injector 10 can be used to dispense the agitation-sensitive ingredients, the suds suppressors, and/or other detersive actives into a water line 12 that supplies water to an automatic washing machine 1. The washing machine 1 is connected with the injector 10, which then connects to the power socket 11. The power socket 11 has a power meter (not shown) integrated, so that it can read the power consumption of the washing machine 1 during any wash and/or rinse cycle. When the water starts flowing from the water line 12 into the washing machine 1, a water flowmeter (FC-1) and a ratio controller (RFC) control the flowrate of detersive actives injected by the injector 10 into the water line 12 as a pre-determined ratio to the incoming water flowrate. The injected detersive actives are continuously mixed with water supplied by the water line 12 by an optional static inline mixer 14, so as to form a continuous flow of wash liquor that enters into the washing machine 1 for treatment of fabrics therein. The RFC ensures that irrespective of the amount of water taken by the washing machine 1 as a function of the type and amount of fabrics inside, the TTW dosages of the detersive actives in the wash liquor so formed remain constant at the pre-determined or desired levels. The injector 10 can be a stand-alone unit as depicted in FIG. 1 herein, or it can be integrated into the washing machine 1 as an integral part thereof (not shown).

Preferably, the agitation-sensitive ingredients, the suds suppressors, and/or other detersive actives are all dosed slowly and continuously into the water line 12 through FC-1 and RFC. Alternatively, one or more of the agitation-sensitive ingredients, the suds suppressors, and/or other detersive actives are dosed directly into the inner or outer drum (not shown) of the washing machine 1 by another flowmeter (FC-2) that is also connected with RFC.

The injector 10 is further connected to the washing machine 1 via internet (wifi) and is configured to leverage some of the information that may be available from the washing machine settings (e.g., the low/high agitation wash cycle selected by the consumer, the stage of wash cycle currently on, etc). Such information can be used to determine the mechanical agitation power, which in turn triggers selective dosing of the agitation-sensitive ingredients and/or suds suppressors.

Test Methods

Test 1: Mechanical Agitation Power

Cleaning performance in a wash system for a given time duration and a given agitation (% of time the drum rotates) is correlated to the amount of mechanical energy dissipated onto the fabrics per kilo of fabrics (W/kg). To estimate the mechanical agitation power, it is necessary to first estimate the mechanical power applied to create the agitation and the amount of fabrics loaded into the automatic washing machine. Once the mechanical power used for creating the mechanical rotation/agitation and the amount of fabrics to be treated are known, the mechanical agitation power applied by the automatic washing machine to the fabrics can then be calculated as (Power Used for Agitation)/(Weight of Dry Fabrics).

Depending on the type of automatic washing machine used and the types of sensors that are available, there are two methods for determining the mechanical power used to create the agitation and the amount of fabrics loaded, as follows:

The first method requires a power meter integrated with the automatic washing machine or with the external injector (for reading the electrical power that the automatic washing machine is utilising during the wash cycle) and a water flowmeter in the water supply line (for measuring the water flow rate and the total amount of water added into the automatic washing machine). A simple algorithm is available for calculating the power utilised for rotating the drum of the automatic washing machine to create mechanical rotation or agitation based on the total power consumption of the automatic washing machine. The algorithm is able to subtract the large power peaks that appear when the heater of the automatic washing machine is on, and it also subtracts a baseline power consumption obtained when the empty drum rotates at the same RPM and the sump is filled with water reaching the bottom of the inner drum. Further assuming a typical percentage of free water, e.g., 20%, over the absorbed water in fabrics (this percentage is accessible from a database depending on the washing machine model and chosen cycle) as well as an average fabric water absorbency of about 2.5 kg of water per kg of dry fabric, the total amount of fabrics in kilograms can be calculated as (Weight of Total Water Added−Weight of Sump Water)/(2.5*1.2)=Weight of Fabrics Treated. The total amount of sump water is the required amount of water to reach the bottom of the inner drum of an automatic washing machine and is typically fixed for a given washing machine model (which can also be accessible from a database depending of the washing machine model used). According to this method, both the mechanical power used for creating the mechanical rotation/agitation and the amount of fabrics to be treated can be estimated at the beginning of each wash cycle.

The second more traditional method, which may be more accurate, requires additional sensors connected with the automatic washing machine for measuring torque of the rotating drum (N*m) and the rotational speed (rotations per second or RPS). Correspondingly, the mechanical power applied by the automatic washing machine to rotate/agitate the fabrics is calculated as Torque (N*m)*2*pi*RPS. The total amount of fabrics can be determined in a manner that is similar to that described in the first method hereinabove. Alternatively, the weight of the loaded dry fabrics can be directly measured using a load cell. Further, the weight of the dry fabrics can be estimated by rotating them at the beginning of the wash cycle and measuring the power needed to rotate such dry fabrics in the drum. Still further, the weight of the dry fabrics can be estimated by using a water pressure sensor to sense when the fabrics are saturated before additional free water is added, and assuming an average fabric water absorbency of about 2.5 kg water per kg of dry fabrics.

When the additional sensors are not available, the first method is used. However, when the additional sensors are available, the second method is used.

Test 2: Stain Removal Measurement

The extent of stain removal performance achieved by any wash cycle is calculated as the color difference between the stain and the textile's background before and after wash (see 2).

The initial color difference is defined as initial noticeability ($AB_i$, Equation 1), whereas the final noticeability ($AD_i$, Equation 2) refers to the color difference between the stains and the textiles' background after the wash. The Stain Removal Index ($SRI_i$) for a given stain i is calculated as described by Equation 3.

$$AB_i = \sqrt{(L_{s_{io}} - L_{b_o})^2 + (a_{s_{io}} - a_{b_o})^2 + (b_{s_{io}} - b_{b_o})^2} \quad \text{Equation 1}$$

$$AD_i = \sqrt{(L_{s_{if}} - L_{b_o})^2 + (a_{s_{if}} - a_{b_o})^2 + (b_{s_{if}} - b_{bo})^2} \quad \text{Equation 2}$$

$$SRI_i(\%) = \frac{IN_i - FN_i}{IN_i} \cdot 100 \quad \text{Equation 3}$$

Where $L_{s_{io}}$, $a_{s_{io}}$, $b_{s_{io}}$ and $L_{s_{if}}$, $a_{s_{if}}$, $b_{s_{if}}$ are the initial and final color coordinates of a given stain i in the L*a*b* color space respectively and $L_{b_o}$, $a_{b_o}$, $b_{b_o}$ are the initial color coordinates of the textiles' background (L*a*b* color space).

EXAMPLES

Example 1: Comparative Stain Removal Performance of Fabric Treatment Process Using Lipase Under Low/High Agitation All experiments are carried out using an Electrolux W565H programmable Front-Loading Washing Machine (FLWM). All machines are cleaned prior to use by conducting a 90° C. cotton cycle. Next, all the experiments are conducted using a washing cycle at 30° C. for 45 minutes.

Different levels of mechanical agitation power during the wash are achieved via the drum rotational speed, the ballast load and the percentage of the total washing time in which the drum of the washing machine is rotating. For example, a washing cycle with low mechanical agitation power of about 10 W/kg can be achieved by using a low drum rotational speed (30 rpm) with 30% of the total washing time in which the drum is rotating (70% rest time) and 4.5 kg of ballast. Higher ballast loads lead to a decrease in the total mechanical agitation power imparted to the fabrics with stains during the wash due to a reduction in the space available within the drum of the washing machine and thus a reduced free fall of the textiles with each rotation of the drum. This results in lower velocity impacts against the inner wall of the drum and thus reduced mechanical action. Alternatively, a high mechanical agitation power of about 34 W/kg during the wash can be achieved by using a high rotational speed (45 rpm) with low ballast load (1.5 kg) and with the drum of the washing machine rotating during 97% of the total washing time. In all cases the ballast load is comprised of 60% of knitted cotton fabric swatches (50 cm×50 cm) and 40% of polycotton fabric swatches (50 cm×50 cm). Furthermore, a set of greasy stains (EQ076 Lard, cooked beef GSRT CBE001, dyed bacon GSRTBGD001) with two internal repeats are added to each wash. The set of stains are comprised of 2 knitted cotton swatches (20 cm×20 cm) containing the stains to be analyzed. All swatches are supplied by Warwick Equest Ltd (UK).

In order to be able to compare the extent of stain removal achieved in each of the wash cycles with low and high mechanical agitation powers respectively, the water-to-ballast-load ratio as well as the chemistry-to-water ratio are maintained constant in all cases. For that purpose, the volume of water added to the washing machine when conducting a wash cycle with 4.5 kg ballast load is 30 L, whereas 10 L of water is added to the washing machine when the wash cycle is conducted with 1.5 kg of ballast load, thereby resulting in a water-to-ballast-load ratio of 6.67 L/kg in all cases. Similarly, the amounts of detergent formulations are adjusted to maintain a constant concentration through the wash in all cases. Higher amount of suds suppressor is added for those experiments conducted with high mechanical action in order to reduce the level of suds and thus increase the mechanical action (since it is known that the suds present during the wash can act as a cushion reducing the impact forces of the textiles against the wall of the washing machine).

The following comparative experiments (A-D) are conducted to test the synergy between lipase enzyme and the high mechanical agitation power present during the wash. All of the experiments are conducted considering 4 external repeats.

A) Low agitation—No lipase: 30 rpm with 30% ON time, 57.75 g of a liquid laundry detergent formulation (see Table 1 below), 0.75 g of suds suppressor, 4.5 kg ballast (resulting in an estimated mechanical agitation power of about 10 W/kg);

B) High agitation—No lipase: 45 rpm with 97% ON time, 19.25 g of a liquid laundry detergent formulation (see Table 1 below), 2.25 g of suds suppressor, 1.5 kg ballast (resulting in an estimated mechanical agitation power of about 34 W/kg);

C) Low agitation with lipase: 30 rpm with 30% ON time, 57.75 g of a liquid laundry detergent formulation (see Table 1 below), 0.75 g of suds suppressor, 0.48 g of 18.64 mg/g lipase (Lipex® from Novozymes in Denmark), 4.5 kg ballast (resulting in an estimated mechanical agitation power of about 10 W/kg); and D) High agitation with lipase: 45 rpm with 97% ON time, 19.25 g of a liquid laundry detergent formulation (see Table 1 below), 2.25 g of suds suppressor, 0.16 g of 18.64 mg/g of lipase (Lipex® from Novozymes in Denmark), 1.5 kg ballast (resulting in an estimated mechanical agitation power of about 34 W/kg).

Table 1 below lists the base liquid laundry detergent composition to be used in all test legs (as TTW of the respective ingredients in the aqueous wash liquor formed thereby):

TABLE 1

| | Ingredients | TTW (ppm) |
|---|---|---|
| Surfactants | Sodium dodecyl benzenesulfonate (LAS) | 357 |
| | C14-15 AA with 7 EO | 202 |
| | C12-14 AES with 3 EO (70%) | 220 |
| | Lauramine oxide | 19 |
| Builders/ Chelant | Fatty Acids | 121 |
| | Citric Acid | 156 |
| | Diethylene triamine penta(methyl phosphonic acid) (DTPMP) | 18 |
| Performance actives/ preservatives | Polymer Lutensit Z96 | 25 |
| | Polyethylene glycol (PEG)-co-polyvinyl acetate (PvAc) | 51 |
| | Brighteners | 4 |
| | Preservatives | 0.1 |
| Enzymes/ stabilizers | Protease | 2 |
| | Na Formate (40% solution) | 52 |
| Solvent/ neutralizer/ structurant | Ethanol | 19 |
| | 1,2 Propylene glycol | 190 |
| | NaOH | 204 |
| | MEA hydrogenated castor oil | 15 |

The experiments are carried out by following the steps described below:

1) 4.5 kg ballast, 1 set of greasy stains with 2 internal repeats (supplied by Warwick Equest Ltd, UK), 1 set of whiteness tracers (supplied by Warwick Equest Ltd, UK), 6 SBL soil sheets (WFK Tesgewebe GmbH, Germany) and 57.75 g of the liquid formulation defined by Table 1 are introduced into the drums of the washing machines running Experiments A) and C);

2) 1.5 kg ballast, 1 set of greasy stains with 2 internal repeats (supplied by Warwick Equest Ltd, UK), 1 set of whiteness tracers (supplied by Warwick Equest Ltd, UK), 2 SBL soil sheets (WFK Tesgewebe GmbH, Germany) and 19.25 g of the liquid formulation defined by Table 1 are introduced into the drums of the washing machines running Experiments B) and D);

3) Next, 0.48 g of 18.64 mg/g Lipex® dissolved in 100 ml of city water is added into the drum of the washing machine running Experiment C), and 0.16 g of 18.64 mg/g of Lipex® dissolved in 100 ml of city water is added into the drum of the washing machine running Experiment D);

4) After ensuring that the water supply is turned onto city water quality, 0.75 g of suds suppressor is added into the drawer of the washing machines running Experiments A) and C), whereas 2.25 g of suds suppressor is added into the drawer of the machines running Experiments B) and D); and 5) Next, the washing cycle is started in each of the washing machines. After each cycle is finished, the SBL sheets are removed from the washing machine, and the ballast load and the stains are introduced in an Electrolux T3290 gas dryer where they are dried for 30 minutes at low temperature.

6) All the washing machines are then rinsed using a 4-minute rinse cycle before commencing the next experiment.

Following Table 2 shows the stain removal performance results obtained for each of the Experiments (A-D). The stain removal index (SRI) is calculated via image analysis under D65 standard illumminant conditions. The results presented are the average of the internal repeats used for each experimental condition and the 4 external repeats.

TABLE 2

| | SRI | | | | | |
|---|---|---|---|---|---|---|
| Stain | A (Reference) | ΔB | ΔC | ΔD | ΔCA | ΔDB |
| EQ076 Lard | 58.4 | 0.9 | −0.7 | 9.5 | −0.7 | 8.6 |
| Cooked Beef GSRT CBE001 | 46.3 | 13.4 | 4 | 27.8 | 4 | 14.3 |
| Dyed Bacon GSRTBGD001 | 57 | 2.2 | 0.8 | 8.8 | 0.8 | 6.6 |

It can be observed that a synergistically higher stain removal benefit is exhibited by the lipase enzyme when the wash is conducted in a system with higher mechanical agitation force (i.e., ΔDB>ΔCA).

Example 2: Comparative Stain Removal Performance of Fabric Treatment Process Using LAS and AES Under Low/High Agitation All experiments are carried out using an Electrolux W565H programmable Front-Loading Washing Machine (FLWM). All machines are cleaned prior to use by conducting a 90° C. cotton cycle. Next, all the experiments are conducted using a washing cycle at 30° C. for 45 minutes.

Different levels of mechanical agitation power during the wash are achieved via the drum rotational speed, the ballast load and the percentage of the total washing time in which the drum of the washing machine is rotating. For example, a washing cycle with low mechanical agitation power of about 10 W/kg can be achieved by using a low drum rotational speed (30 rpm) with 30% of the total washing time in which the drum is rotating (70% rest time) and 4.5 kg of ballast. Higher ballast loads lead to a decrease in the total mechanical agitation power imparted to the fabrics with stains during the wash due to a reduction in the space available within the drum of the washing machine and thus a reduced free fall of the textiles with each rotation of the drum. This results in lower velocity impacts against the inner wall of the drum and thus reduced mechanical action. Alternatively, a high mechanical agitation power of about 34 W/kg during the wash can be achieved by using a high rotational speed (45 rpm) with low ballast load (1.5 kg) and with the drum of the washing machine rotating during 97% of the total washing time. In all cases the ballast load is comprised of 60% of knitted cotton fabric swatches (50 cm×50 cm) and 40% of polycotton fabric swatches (50 cm×50 cm). Furthermore, a set of greasy stains (EQ076 Lard, cooked beef GSRT CBE001, dyed bacon GSRTBGD001) with two internal repeats are added to each wash. The set of stains are comprised of 2 knitted cotton swatches (20 cm×20 cm) containing the stains to be analyzed. All swatches are supplied by Warwick Equest Ltd (UK).

In order to be able to compare the extent of stain removal achieved in each of the wash cycles with low and high mechanical agitation powers respectively, the water-to-ballast-load ratio as well as the chemistry-to-water ratio are maintained constant in all cases. For that purpose, the volume of water added to the washing machine when conducting a wash cycle with 4.5 kg ballast load is 30 L, whereas 10 L of water is added to the washing machine when the wash cycle is conducted with 1.5 kg of ballast load, thereby resulting in a water-to-ballast-load ratio of 6.67 L/kg in all cases. Similarly, the amounts of detergent formulations are adjusted to maintain a constant concentration through the wash in all cases. Higher amount of suds suppressor is added for those experiments conducted with high mechanical action in order to reduce the level of suds and thus increase the mechanical action (since it is known that the suds present during the wash can act as a cushion reducing the impact forces of the textiles against the wall of the washing machine).

The following comparative experiments (E-H) are conducted to test the synergy between lipase enzyme and the high mechanical agitation power present during the wash. All of the experiments are conducted considering 4 external repeats.

E) Low agitation—No LAS: 30 rpm with 30% ON time, 57.75 g of a liquid laundry detergent formulation (E) (see Table 3 below), 0.75 g of suds suppressor, 4.5 kg ballast (resulting in an estimated mechanical agitation power of about 10 W/kg);

F) High agitation—No LAS: 45 rpm with 97% ON time, 19.25 g of a liquid laundry detergent formulation (F) (see Table 3 below), 2.25 g of suds suppressor, 1.5 kg ballast (resulting in an estimated mechanical agitation power of about 34 W/kg);

G) Low agitation with LAS: 30 rpm with 30% ON time, 57.75 g of a liquid laundry detergent formulation (G) (see Table 3 below), 0.75 g of suds suppressor, 4.5 kg ballast (resulting in an estimated mechanical agitation power of about 10 W/kg); and H) High agitation with LAS: 45 rpm with 97% ON time, 19.25 g of a liquid laundry detergent formulation (H) (see Table 3 below), 2.25 g of suds suppressor, 1.5 kg ballast (resulting in an estimated mechanical agitation power of about 34 W/kg).

Table 3 below lists ingredients in the above-mentioned liquid laundry detergent compositions (E)-(F), as TTW of the respective ingredients in the aqueous wash liquor formed thereby:

TABLE 3

| | Ingredients | E (ppm) | F (ppm) | G (ppm) | H (ppm) |
|---|---|---|---|---|---|
| Surfactants | Sodium dodecyl benzenesulfonate (LAS) | 0 | 0 | 377.56 | 377.56 |
| | C14-15 AA with 7 EO | 190.65 | 190.65 | 190.65 | 190.65 |
| | C12-14 AES with 3 EO (70%) | 316.86 | 316.86 | 316.86 | 316.86 |
| | Lauramine oxide | 18.87 | 18.87 | 18.87 | 18.87 |

TABLE 3-continued

| | Ingredients | E (ppm) | F (ppm) | G (ppm) | H (ppm) |
|---|---|---|---|---|---|
| Builders/ Chelant | Fatty Acids | 96.25 | 96.25 | 96.25 | 96.25 |
| | Citric Acid | 71.57 | 71.57 | 71.57 | 71.57 |
| | Diethylene triamine penta(methyl phosphonic acid) (DTPMP) | 22.58 | 22.58 | 22.58 | 22.58 |
| Performance actives/ preservatives | Polymer Lutensit Z96 | 33.15 | 33.15 | 33.15 | 33.15 |
| | Polyethylene glycol (PEG)-co-polyvinyl acetate (PvAc) | 28.92 | 28.92 | 28.92 | 28.92 |
| | Preservatives | 0.1 | 0.1 | 0.1 | 0.1 |
| Enzymes/ stabilizers | Protease | 0.93 | 0.93 | 0.93 | 0.93 |
| | Amylase | 0.12 | 0.12 | 0.12 | 0.12 |
| | Mannanase | 0.09 | 0.09 | 0.09 | 0.09 |
| | Pectate Lyase | 0.05 | 0.05 | 0.05 | 0.05 |
| | Na Formate (40% solution) | 7.7 | 7.7 | 7.7 | 7.7 |
| Solvent/ neutralizer/ structurant | Ethanol | 17.98 | 17.98 | 17.98 | 17.98 |
| | 1,2 Propylene glycol | 312.81 | 312.81 | 312.81 | 312.81 |
| | NaOH | 61.6 | 61.6 | 61.6 | 61.6 |
| | MEA hydrogenated castor oil | 5 | 5 | 5 | 5 |
| Antifoam | Silicone emulsion | 0.05 | 0.05 | 0.05 | 0.05 |

The detergent formulations used in Experiments E)-H) are designed to test the difference in benefits obtained in stain removal when the concentration of LAS increases from 0 ppm to about 377 ppm in wash cycles characterized by low mechanical agitation power in comparison with wash cycles characterized by high mechanical agitation power.

The experiments are carried out by following the steps described below:

1) 4.5 kg ballast, 1 set of greasy stains with 2 internal repeats (supplied by Warwick Equest Ltd, UK), 1 set of whiteness tracers (supplied by Warwick Equest Ltd, UK), 6 SBL soil sheets (WFK Tesgewebe GmbH, Germany) and 57.75 g of the liquid formulation (E) are introduced into the drum of the washing machines running Experiment E), wherein 4.5 kg ballast, 1 set of greasy stains with 2 internal repeats (supplied by Warwick Equest Ltd, UK), 1 set of whiteness tracers (supplied by Warwick Equest Ltd, UK), 6 SBL soil sheets (WFK Tesgewebe GmbH, Germany) and 57.75 g of the liquid formulation (G) are introduced into the drum of the washing machines running Experiment G);

2) 1.5 kg ballast, 1 set of greasy stains with 2 internal repeats (supplied by Warwick Equest Ltd, UK), 1 set of whiteness tracers (supplied by Warwick Equest Ltd, UK), 2 SBL soil sheets (WFK Tesgewebe GmbH, Germany) and 19.25 g of the liquid formulation (F) are introduced into the drum of the washing machines running Experiment F), whereas 0.5 kg ballast, 1 set of greasy stains with 2 internal repeats (supplied by Warwick Equest Ltd, UK), 1 set of whiteness tracers (supplied by Warwick Equest Ltd, UK), 2 SBL soil sheets (WFK Tesgewebe GmbH, Germany) and 19.25 g of the liquid formulation (H) are introduced into the drum of the washing machines running Experiment H);

3) After ensuring that the water supply is turned onto city water quality, 0.75 g of suds suppressor is added into the drawer of the washing machines running Experiments E) and G), whereas 2.25 g of suds suppressor is added into the drawer of the machines running Experiments F) and H); and 4) Next, the washing cycle is started in each of the washing machines. After each cycle is finished, the SBL sheets are removed from the washing machine, and the ballast load and the stains are introduced in an Electrolux T3290 gas dryer where they are dried for 30 minutes at low temperature.

6) All the washing machines are then rinsed using a 4-minute rinse cycle before commencing the next experiment.

Following Table 4 shows the stain removal performance results obtained for each of the Experiments (E-H). The stain removal index (SRI) is calculated via image analysis under D65 standard illumminant conditions. The results presented are the average of the internal repeats used for each experimental condition and the 4 external repeats.

TABLE 4

| | SRI | | | | | |
|---|---|---|---|---|---|---|
| Stain | E (Reference) | ΔF | ΔG | ΔH | ΔGE | ΔHF |
| Sebum (PCS-94) | 43.05 | 3.40 | 1.84 | 14.28 | 1.84 | 10.88 |
| Cooked Beef (GSRTCBE001) | 20.51 | 14.32 | 14.36 | 38.97 | 14.36 | 24.64 |
| Make-Up (GSRTCGM001) | 17.26 | 5.69 | 12.19 | 28.07 | 12.19 | 22.38 |
| Scrubbed Grass (EQ-062) | 59.56 | −1.01 | 2.41 | 10.67 | 2.41 | 11.68 |

It can be observed that a synergistically higher stain removal benefit is exhibited by the LAS when the wash is conducted in a system with higher mechanical agitaion force (i.e., ΔHF>ΔGE).

Experiments (I)-(L) similar to those described hereinabove are carried out by using AES, instead of LAS, under low/high agitations as follows:

The following comparative experiments (I-L) are conducted to test the synergy between lipase enzyme and the high mechanical agitation power present during the wash. All of the experiments are conducted considering 4 external repeats.

I) Low agitation—No AES: 30 rpm with 30% ON time, 57.75 g of a liquid laundry detergent formulation (I) (see Table 5 below), 0.75 g of suds suppressor, 4.5 kg ballast (resulting in an estimated mechanical agitation power of about 10 W/kg);

J) High agitation—No AES: 45 rpm with 97% ON time, 19.25 g of a liquid laundry detergent formulation (J) (see Table 5 below), 2.25 g of suds suppressor, 1.5 kg ballast (resulting in an estimated mechanical agitation power of about 34 W/kg);

K) Low agitation with AES: 30 rpm with 30% ON time, 57.75 g of a liquid laundry detergent formulation (K) (see Table 5 below), 0.75 g of suds suppressor, 4.5 kg ballast (resulting in an estimated mechanical agitation power of about 10 W/kg); and L) High agitation with AES: 45 rpm with 97% ON time, 19.25 g of a liquid laundry detergent formulation (L) (see Table 5 below), 2.25 g of suds suppressor, 1.5 kg ballast (resulting in an estimated mechanical agitation power of about 34 W/kg).

Table 5 below lists ingredients in the above-mentioned liquid laundry detergent compositions (I)-(L), as TTW of the respective ingredients in the aqueous wash liquor formed thereby:

TABLE 5

| | Ingredients | I (ppm) | J (ppm) | K (ppm) | L (ppm) |
|---|---|---|---|---|---|
| Surfactants | Sodium dodecyl benzenesulfonate (LAS) | 377.56 | 377.56 | 377.56 | 377.56 |
| | C14-15 AA with 7 EO | 190.65 | 190.65 | 190.65 | 190.65 |
| | C12-14 AES with 3 EO (70%) | 0 | 0 | 316.86 | 316.86 |
| | Lauramine oxide | 18.87 | 18.87 | 18.87 | 18.87 |
| Builders/ Chelant | Fatty Acids | 96.25 | 96.25 | 96.25 | 96.25 |
| | Citric Acid | 71.57 | 71.57 | 71.57 | 71.57 |
| | Diethylene triamine penta(methyl phosphonic acid) (DTPMP) | 22.58 | 22.58 | 22.58 | 22.58 |
| Performance actives/ preservatives | Polymer Lutensit Z96 | 33.15 | 33.15 | 33.15 | 33.15 |
| | Polyethylene glycol (PEG)-co-polyvinyl acetate (PvAc) | 28.92 | 28.92 | 28.92 | 28.92 |
| | Preservatives | 0.1 | 0.1 | 0.1 | 0.1 |
| Enzymes/ stabilizers | Protease | 0.93 | 0.93 | 0.93 | 0.93 |
| | Amylase | 0.12 | 0.12 | 0.12 | 0.12 |
| | Mannanase | 0.09 | 0.09 | 0.09 | 0.09 |
| | Pectate Lyase | 0.05 | 0.05 | 0.05 | 0.05 |
| | Na Formate (40% solution) | 7.7 | 7.7 | 7.7 | 7.7 |
| Solvent/ neutralizer/ structurant | Ethanol | 17.98 | 17.98 | 17.98 | 17.98 |
| | 1,2 Propylene glycol | 312.81 | 312.81 | 312.81 | 312.81 |
| | NaOH | 61.6 | 61.6 | 61.6 | 61.6 |
| | MEA hydrogenated castor oil | 5 | 5 | 5 | 5 |
| Antifoam | Silicone emulsion | 0.05 | 0.05 | 0.05 | 0.05 |

Following Table 6 shows the stain removal performance results obtained for each of the Experiments (I-L). The stain removal index (SRI) is calculated via image analysis under D65 standard illumminant conditions. The results presented are the average of the internal repeats used for each experimental condition and the 4 external repeats.

TABLE 6

| | SRI | | | | | |
|---|---|---|---|---|---|---|
| Stain | I (Reference) | ΔJ | ΔK | ΔL | ΔKI | ΔLJ |
| Sebum (PCS-94) | 34.62 | 14.21 | 8.52 | 19.70 | 8.52 | 5.49 |
| Cooked Beef (GSRTCBE001) | 39.36 | 19.31 | −1.96 | 18.88 | −1.96 | −0.42 |
| Make-Up (GSRTCGM001) | 25.00 | 20.86 | 0.52 | 18.35 | 0.52 | −2.50 |
| Scrubbed Grass (EQ-062) | 50.69 | 12.21 | 11.20 | 20.78 | 11.20 | 8.58 |

It can be observed that unlike LAS, there is no extra stain removal benefit achieved by AES when it is used in a washing cycle with high mechanical agitation versus low mechanical agitation (i.e., ΔLJ<ΔKI). Therefore, the synergy in SRI observed between LAS and high mechanical agitation is surprising and unexpected.

Example 3: Comparative Whiteness Maintenance Benefit of SRP Under Low/High Agitation All experiments are conducted in a mid-scale high throughput equipment that runs on a Peerless Systems platform. It consists of 10 vessels of 1-L capacity each with a three-blade post agitator similar to the one used by Ganguli and Eenderbug (1980) which operate in parallel. The equipment is automatized so that filling, washing, draining and rinsing of the vessels is automatically conducted by the system.

Initially, cleaning of the vessels is conducted prior to start the wash process by adding 0.25 L of city water at the target washing temperature (30° C.) to each of the vessels of the equipment. The water remains in the vessels for 2 min under a constant agitation of 1800°/s. After draining the water used for the cleaning stage, 0.8 L of city water at the target washing temperature (30° C.) are added to each of the vessels. Next, 0.2 L of city water containing a pre-dissolved liquid detergent formulation M or N (see Table 7) and 0.02 L of SBL soil dispersed in city water are manually added to each of the vessels and mixed for 2 minutes under a constant agitation of 300 rpm.

Table 7 below lists ingredients in the above-mentioned liquid laundry detergent compositions (M) and (N), as TTW of the respective ingredients in the aqueous wash liquor formed thereby:

TABLE 7

| | Ingredients | M (ppm) | N (ppm) |
|---|---|---|---|
| Surfactants | LAS | 367.94 | 367.94 |
| | C14-15 AA with 7 EO | 188.03 | 188.03 |
| | C12-14 AES with 3 EO (70%) | 284.18 | 284.18 |
| | C12-C14 amine oxide | 28.63 | 28.63 |
| Builders/ Chelant | Fatty Acids | 86.33 | 86.33 |
| | Citric Acid (50%) | 108.62 | 108.62 |
| | HEDP | 25 | 25 |
| | Diethylene triamine penta(methyl phosphonic acid) (DTPMP) | 25 | 25 |

TABLE 7-continued

| | Ingredients | M (ppm) | N (ppm) |
|---|---|---|---|
| Performance actives/ preservatives | Zwitterionic hexamethylene diamine | 29.74 | 29.74 |
| | SRN260 | 0 | 35 |

Afterwards, the ballast comprising 50 g of knitted cotton swatches (5 cm×5 cm) and the whiteness tracers comprising 4 swatches (5 cm×5 cm) of polyester (PE), Knitted cotton (KC), polycotton (PC) and Polyamide Spandex (NS) respectively are added to each of the vessels prior to start the wash process.

The impact of the mechanical agitation on the level of soil deposited on the textiles is tested by conducting two different wash cycles with respectively low mechanical agitation action (rotating at 70 rpm which results in an agitation power of about 3 W/kg) and high mechanical agitation action (rotating at 300 rpm which results in an agitation power of about 14 W/kg) during the wash with and without the presence of the soil release polymer SRN260 in the wash liquor (which is formed by using the liquid laundry detergent composition M or N, respectively). The main wash is conducted for 30 minutes followed by a 2-min rinsing step at 70 rpm in all cases. Table 8 at below summarizes the four (4) experimental conditions used for testing the impact of low/high mechanical agitation and SRP on the final whiteness of the textiles.

TABLE 8

| Test Leg | Main Wash | Rinse |
|---|---|---|
| Composition M (no SRP) + High Mechanical action at 14 W/Kg | 300 rpm, 30 min | 70 rpm, 2 min |
| Composition N (SRP) + High Mechanical action at 14 W/Kg | 300 rpm, 30 min | 70 rpm 2 min |
| Composition M (no SRP) + Low mechanical action at 3 W/Kg | 70 rpm, 30 min | 70 rpm, 2 min |
| Composition N (SRP) + Low mechanical action at 3 W/Kg | 70 rpm, 30 min | 70 rpm 2 min |

Next, the polyester textiles are removed from the vessels and dried for 1 hour at low temperature in an Electrolux T3290 gas dryer prior to measure the CIE (Comission Internationale de l'Eclairage) Whiteness Index (WI) of the whiteness tracers by reflectance spectrophotometry (Konica Minolta CM-3610d) considering a 10 observer under CIE standard D65 illuminant (daylight, outdoor conditions).

The following Table 9 summarizes the experimental results obtained expressed as the average CIE WI of 4 internals and 4 external repeats conducted for each experimental condition described in Table 8.

TABLE 9

| Test Leg | CIE WI pre-wash (PE) | CIE WI post-wash (PE) | ΔCIE WI by adding SRN260 | STD |
|---|---|---|---|---|
| Composition M (no SRP) + High mechanical action | 164.93 | 126.48 | 35.82 | 0.87 |
| Composition N (SRP) + High mechanical action | 164.97 | 162.30 | | |
| Composition M (no SRP) + Low mechanical action | 164.92 | 134.58 | 27.26 | 1.62 |
| Composition N (SRP) + Low mechanical action | 164.86 | 161.84 | | |

It can be observed that SRN260 exhibits a statistically significant increase in its whiteness maintenance benefit (i.e., ΔCIE WI caused by adding SRN260) when it is used in a high agitation wash cycle, in comparison with when it is used in a low agitation wash cycle. This is surprising and counter-intuitive because high mechanical agitation is known to result in greater whiteness loss during wash, i.e., (CIE WI post-wash—CIE WI pre-wash) measured after a high agitation wash cycle is typically more negative than that measured after a low agitation cycle.

Example 4: Exemplary Low/High-Agitation Liquid Laundry Detergent Formulations

Following are some exemplary low-agitation laundry detergent formulations ("LA") and high-agitation liquid laundry detergent formulations ("HA") according to the present invention:

| Ingredients (wt %) | LA 1 | HA 1 | LA 2 | HA2 | LA 3 | HA 3 | LA 4 | HA 4 |
|---|---|---|---|---|---|---|---|---|
| LAS | 5-25 | 20-50 | 10 | 30 | 14.5 | 30 | 20 | 20 |
| AES with 3EO (70%) | 5-30 | 0-10 | 15 | 0 | 11.2 | 0 | 5 | 5 |
| AA with 7 EO | 0-15 | 0-5 | 5 | 0 | 0.67 | 0 | 5 | 5 |
| Lipase | 0-0.003 | 0-0.03 | 0.002 | 0.02 | 0 | 0.01 | 0 | 0.01 |
| SRN260 | 0-2 | 0-6 | 0 | 4 | 0.7 | 1.38 | 1 | 1 |
| Water | Q.S. | Q.S. | Q.S. | Q.S. | Q.S. | Q.S. | Q.S. | Q.S. |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of treating fabrics using an automatic laundry washing machine, comprising the steps of:

a) providing an automatic laundry washing machine configured for adding a plurality of detersive actives comprising at least one agitation-sensitive ingredient during a wash cycle, wherein said automatic laundry washing machine comprises two cartridges, one of which is configured to house a first liquid laundry detergent composition comprising the agitation-sensitive ingredient, and the other of which is configured to house a second liquid laundry detergent composition, b) conducting a measurement of mechanical agitation power in the automatic laundry washing machine during the wash cycle;

c) adding said first liquid laundry detergent composition into a wash liquor, provided that the determined mechanical agitation power is more than 12 W/kg; and d) operating said automatic laundry washing machine to treat fabrics by using said wash liquor, wherein the mechanical agitation power is power used for agitation/weight of dry fabrics.

2. The method of claim 1, wherein said determined mechanical agitation power is more than 17 W/kg.

3. The method of claim 2, wherein said lipase is added into the wash liquor during step (c) to achieve a Through-the-Wash dosage of from 0.05 ppm to 2 ppm.

4. The method of claim 1, wherein said at least one agitation-sensitive ingredient comprises a lipase.

5. The method according to claim 1, wherein said at least one agitation-sensitive ingredient comprises a $C_{10}$-$C_{20}$ linear alkyl benzene sulphonate; and wherein said $C_{10}$-$C_{20}$ linear alkyl benzene sulphonate is added into the wash liquor during step (c) to achieve a TTW dosage of from 100 ppm to 1500 ppm.

6. The method according to claim 1, wherein said at least one agitation-sensitive ingredient comprises a polyester-based soil release polymer; and wherein said polyester-based soil release polymer is added into the wash liquor during step (c) to achieve a TTW dosage of from 5 ppm to 150 ppm.

7. The method according to claim 1, wherein the wash liquor is substantially free of the agitation-sensitive ingredient before the addition in step (c).

8. The method according to claim 1, wherein the wash liquor comprises the agitation-sensitive ingredient before the addition in step (c), but at a lower Through-the-Wash dosage.

9. The method of claim 1, second liquid laundry detergent composition is substantially free of said at least one agitation-sensitive ingredient.

10. The method of claim 1, wherein said first liquid laundry detergent composition comprises said at least one agitation-sensitive ingredient at a first concentration, and wherein the second liquid laundry detergent composition comprises said at least one agitation-sensitive ingredient at a second, lower concentration.

11. The method according to claim 1, wherein said second liquid detergent composition is a pre-treatment formulation that is added into the wash liquor before step (c), and wherein said first liquid detergent composition is added subsequently into the wash liquor during step (c).

12. The method according to claim 1, wherein said liquid detergent composition is added into the wash liquor during step (c) if the determined mechanical agitation power is equal to or below 12 W/kg.

13. A method of treating fabrics using an automatic laundry washing machine, comprising the steps of:

a) providing an automatic laundry washing machine configured for adding a plurality of detersive actives during a wash cycle, wherein said plurality of detersive actives comprise at least one agitation-sensitive ingredient;

b) conducting a measurement of mechanical agitation power in the automatic laundry washing machine during the wash cycle;

c) adding said at least one agitation-sensitive ingredient into a wash liquor, provided that the determined mechanical agitation power is more than 12 W/kg;

d) operating said automatic laundry washing machine to treat fabrics by using said wash liquor;

e) conducting another measurement of the mechanical agitation power in the automatic laundry washing machine; and f) subsequently, adding a suds suppressor into said wash liquor if the measured mechanical agitation power decreases below 12 W/kg.

14. The method according to claim 13, wherein said suds suppressor is added into the wash liquor during step (f) to achieve a Through-the-Wash dosage of the suds suppressor of from 50 ppm to 1000 ppm.

* * * * *